US007501596B2

(12) United States Patent
Bradley et al.

(10) Patent No.: US 7,501,596 B2
(45) Date of Patent: Mar. 10, 2009

(54) DIMENSION SENSOR AND METHOD FOR STOPPING EXPANSION OF A TUBE

(75) Inventors: Randall Stuart Bradley, Ellicott City, MD (US); Jason Edward Shearer, Sac City, IA (US); David Ross Blecha, Jr., Carlyle, IL (US)

(73) Assignee: Evapco, Inc., Westminster, MD (US)

( * ) Notice: Subject to any disclaimer, the term of this patent is extended or adjusted under 35 U.S.C. 154(b) by 544 days.

(21) Appl. No.: 11/166,085

(22) Filed: Jun. 27, 2005

(65) Prior Publication Data

US 2006/0288718 A1 Dec. 28, 2006

(51) Int. Cl.
*H01H 35/36* (2006.01)

(52) U.S. Cl. ..... 200/81.8; 73/866.5; 356/32

(58) Field of Classification Search ..... 200/81.8, 200/81 R, 83 S; 73/866.5, 705; 356/32, 356/34, 345, 350

See application file for complete search history.

(56) References Cited

U.S. PATENT DOCUMENTS 3,432,905 A 3/1969 Monroe
3,546,763 A 12/1970 Pasternak
4,210,991 A 7/1980 Cooper, Jr.
4,649,492 A 3/1987 Sinha et al.
4,649,493 A 3/1987 Castner et al.
4,827,605 A 5/1989 Krips et al.
5,301,424 A 4/1994 Snyder
5,765,284 A 6/1998 Ali et al.
6,495,777 B1 * 12/2002 Chou ..... 200/83 R
6,523,414 B1 * 2/2003 Malmstrom et al. ..... 73/705

* cited by examiner

*Primary Examiner*—Kyung Lee
(74) *Attorney, Agent, or Firm*—Rader, Fishman & Grauer PLLC

(57) ABSTRACT

A dimension sensor is used in conjunction with a tube and includes a body member and at least one detector element. The body member has an inner surface defining an opening sized to receive the tube. The at least one detector element is connected to the body member and has a detector portion extending into the opening. When the tube is received in the opening, the detector portion is initially disposed apart from the tube. A method using the dimension sensor stops expansion of the tube expanding from a pre-expanded state to a desired expanded state. A pumping device is actuated to pressurize a fluid by an amount sufficient to cause the tube to expand from the pre-expanded state to the desired expanded state. When the tube expands to the desired expanded state, the pumping device deactivates thereby stopping expansion of the tube at the desired expanded state.

10 Claims, 13 Drawing Sheets

DIMENSION SENSOR AND METHOD FOR STOPPING EXPANSION OF A TUBE

FIELD OF THE INVENTION

The present invention relates to a dimension sensor. More particularly, the present invention is directed to a dimension sensor that is used in conjunction with a tube during a tube expansion process so that, when the tube achieves a desired expanded state, the tube expansion process terminates. The present invention is also directed to a method for stopping expansion of an expanding tube when the tube achieves the desired expanded state.

BACKGROUND OF THE INVENTION

In the manufacture of a conventional heat exchanger, heat exchanger tubes are inserted through respective aligned holes in a plurality of spaced-apart plate fins. Initially, the heat exchanger tubes are rather loosely received in the holes of the plate fins. It is necessary to expand the heat exchanger tubes in the holes of the plate fins so that the heat exchanger tubes are in a close-fitting, interference contact with the plate fins.

A conventional system for constructing heat exchangers using fluidic expansion by employing a fluid expansion is disclosed in U.S. Pat. No. 5,765,284 to Ali et al. As shown in FIG. 1, a compressor 2 of a tube expansion system 3 compresses an expansion fluid, specifically, a compressible fluid, from an expansion fluid reservoir 4 through a high-pressure safety valve 6 to the heat exchanger 8 via pipes 10*a* and 10*b*. The expansion fluid under high-pressure enters a tubing circuit 12 of the heat exchanger 8 through a connector 14 which is sealed to an inlet of the tubing circuit 12. The tubing circuit 12 is a serpentine structure of connected heat exchanger tubes 16. The connector 14 is a high-pressure connector capable of remaining sealed while delivering the expansion fluid at several thousand pounds per square inch. Upon introduction of the high-pressure fluid into the tubing circuit 12, the heat exchanger tubes 16 of the serpentine structure 16 expand radially outwardly to form secure contact with plate fins 18 and tube sheets 20. A plug 22 seals an outlet of the tubing circuit 12.

As shown in FIG. 1, controls 24 govern the amount of pressure the compressor 2 supplies to the tubing circuit 12. The controls 24 also terminate compression of the compressor 2 when sufficient expansion of the heat exchanger tubes 16 has been achieved by shutting off a power supply 26 supplying power to the compressor 2 through the controls 24. The controls 24 are used in conjunction with a displacement sensor 28. The displacement sensor 28 physically measures the increase in tubing diameter of a portion of one heat exchanger tube 16 of the tubing circuit 12. The displacement sensor 28 provides feedback of the expansion progress of the heat exchanger tubes 16 to the controls 24. In this manner, the controls 24 are set to stop the expansion of the heat exchanger tubes 16 once the circuit reaches a certain diameter. Alternatively, the controls 24 can vary the pressure of the expansion fluid during the expansion process. The controls 24 are essentially a microprocessor programmed in such a manner as to perform the above-stated objectives.

Another conventional tube expansion system for constructing heat exchangers uses an incompressible fluid such as water as opposed to U.S. Pat. No. 5,765,284 that uses a compressible fluid. However, other than one system using an incompressible fluid while the other uses a compressible fluid, the conventional systems for expanding heat exchanger tubes to construct heat exchangers using a fluid are generally similar in structure and function.

OBJECTS AND SUMMARY OF THE INVENTION

It is an object of the invention to provide a dimension sensor for use in manufacturing heat exchangers that shuts off a pumping device of a tube expansion system when an outer surface of the tube expands from a pre-expanded state to a desired expanded state.

It is another object of the invention to provide a dimension sensor and a method for stopping expansion of a heat exchanger tube expanding from a pre-expanded state when the heat exchanger tube expands to the desired expanded state.

It is yet another object of the invention to provide a dimension sensor and a method for stopping expansion of a tube expanding from a pre-expanded state to a desired expanded state when the tube is being expanded from a pre-expanded state to the desired expanded state by a fluid pressurized by a pumping device.

Accordingly, a dimension sensor of the present invention and a method of the present invention for stopping expansion of a tube when the desired expanded state is achieved are hereinafter described.

One embodiment of a dimension sensor of the present invention is used in conjunction with a tube and includes a body member and at least one detector element. The body member has an outer surface and an inner surface defining an opening sized to receive the tube. The at least one detector element is connected to the body member and has a detector portion extending into the opening. When the tube is received in the opening, the detector portion is initially disposed apart from the tube.

Another embodiment of a dimension sensor of the present invention is used in conjunction with a tube fabricated from an electrically conductive material to shut off a pumping device of a tube expansion system when a tubular outer surface of the tube expands from a pre-expanded state to a desired expanded state. The dimension sensor includes a body member as mentioned above and a plurality of detector elements. Each detector element is connected to the body member and has a detector portion extending into the opening. The detector portions are disposed apart from one another at a distance representing the desired expanded state of the tubular outer surface of the tube. In an opened electrical circuit condition, the tubular outer surface of the tube fails to simultaneously contact the plurality of detector elements thereby allowing expansion of the tubular outer surface. In a closed electrical circuit condition, the tubular outer surface of the tube simultaneously contacts the plurality of detector elements thereby shutting off the pumping device and thereby terminating expansion of the tubular outer surface.

Yet another embodiment of the invention is a method for stopping expansion of a tube expanding from a pre-expanded state to a desired expanded state. The tube is expanded from a pre-expanded state to the desired expanded state by a fluid pressurized by a pumping device. The method includes the step of actuating the pumping device to pressurize the fluid by an amount sufficient to cause the tube to expand from the pre-expanded state to the desired expanded state. The method also includes the step of providing a detector element operative in conjunction with the tube in the desired expanded state such that, when the tube expands to the desired expanded state, the pumping device deactivates thereby stopping expansion of the tube at the desired expanded state.

These objects and other advantages of the present invention will be better appreciated in view of the detailed description of the exemplary embodiments of the present invention with reference to the accompanying drawings, in which:

DETAILED DESCRIPTION OF THE EXEMPLARY EMBODIMENTS

Figure 1:
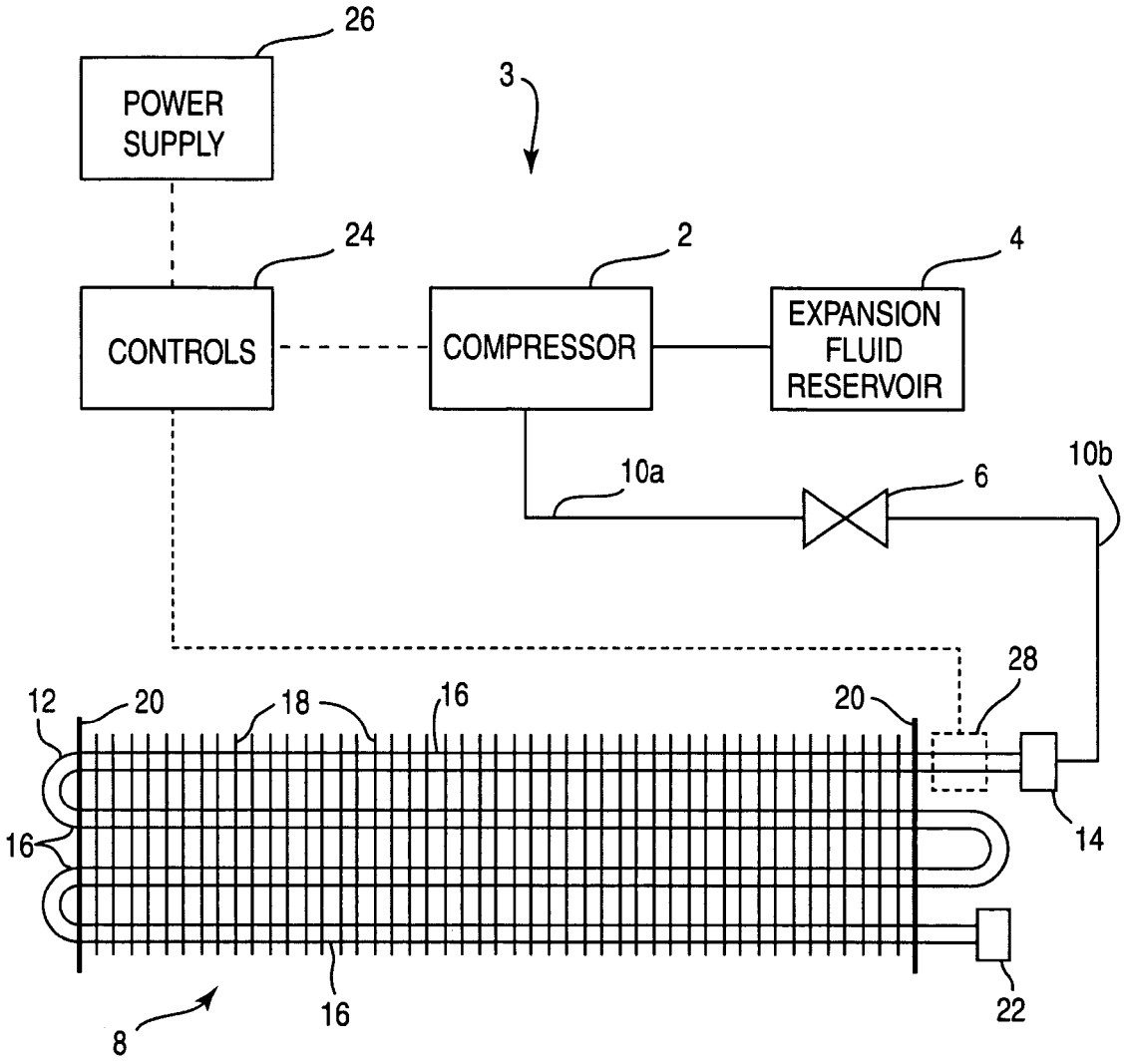
FIG.1 PRIOR ART
FIG. 1 is a diagrammatical view of a conventional system and method for expanding heat exchanger tubes inserted in plate fins in the manufacture of a heat exchanger.

Hereinafter, embodiments of the present invention will be described with reference to the attached drawings. The structural components common to those of the prior art and the structural components common to respective embodiments of the present invention will be represented by the same reference numbers and repeated description thereof will be omitted.

A first exemplary embodiment of a dimension sensor 110 of the present invention is hereinafter described with reference to FIGS. 2-7B. As introduced in FIG. 2, the dimension sensor 110 is disposed between the connector 14 and the tube sheet 20. Although not by way of limitation, heat exchanger tube 16 to be expanded is actually two heat exchanger tubes 16 connected together at ends opposite the dimension sensor 110 by a tube joint 112 bent into a semicircle to form a loop.

A skilled artisan would appreciate the heat exchanger tube 16 to be expanded might be a single length, two connected lengths formed into a loop as illustrated, multiple connected lengths or all of the lengths connected together. At the terminal end of the loop, i.e. below the dimension sensor 110 is a check valve 114. It is preferred but not required that a pumping device 114 pumps an incompressible fluid from the fluid reservoir 116 such as water. The pumping device 114 pumps the incompressible fluid through a first pipe 118*a*, a pressure relief valve 120, a second pipe 118*b*, the connector 14 and into the loop. The check valve 114 allows any air to bleed therethrough when the pumping device 114 is initially activated. Once the air is bled, the check valve 114 closes to allow the incompressible fluid to build up pressure at an amount sufficient to expand the loop of heat exchanger tubes 16. The pressure relief valve 120 acts as a safety in the event of over-pressurization by the pumping device 114.

Figure 5A:
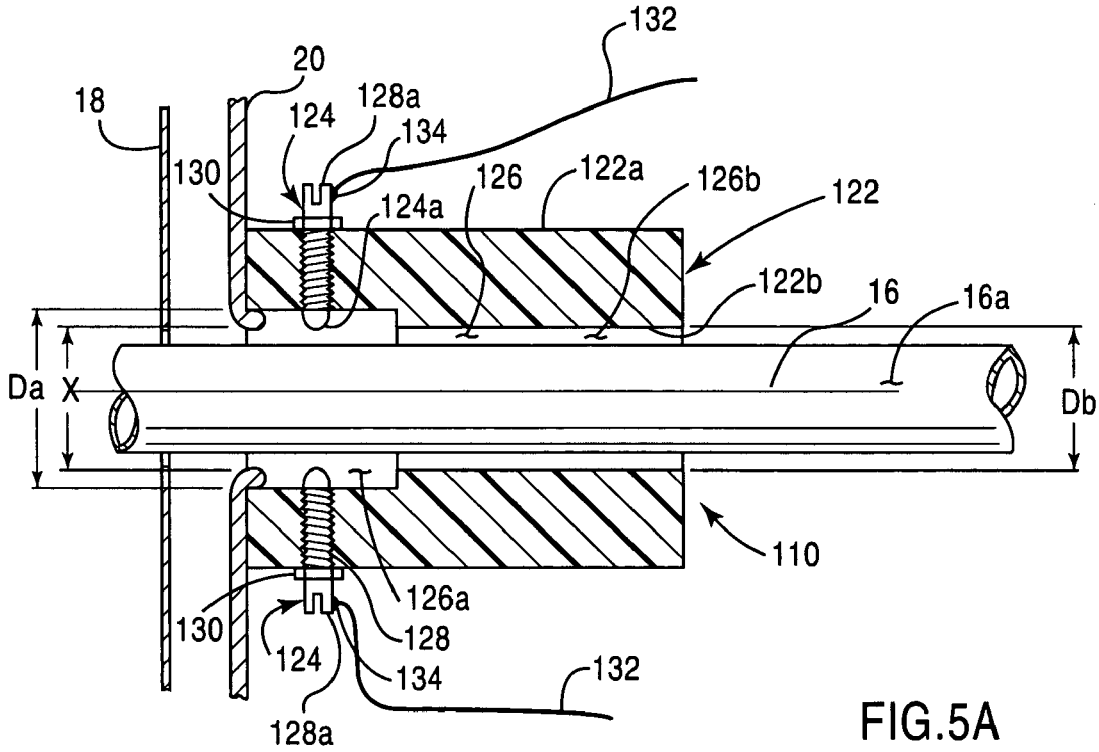
FIG. 5A is an enlarged cross-sectional view of the first exemplary embodiment of the dimension sensor of the present invention surrounding a tube in a pre-expanded state and disposed against a tube sheet of a heat exchanger.
Figure 5B:
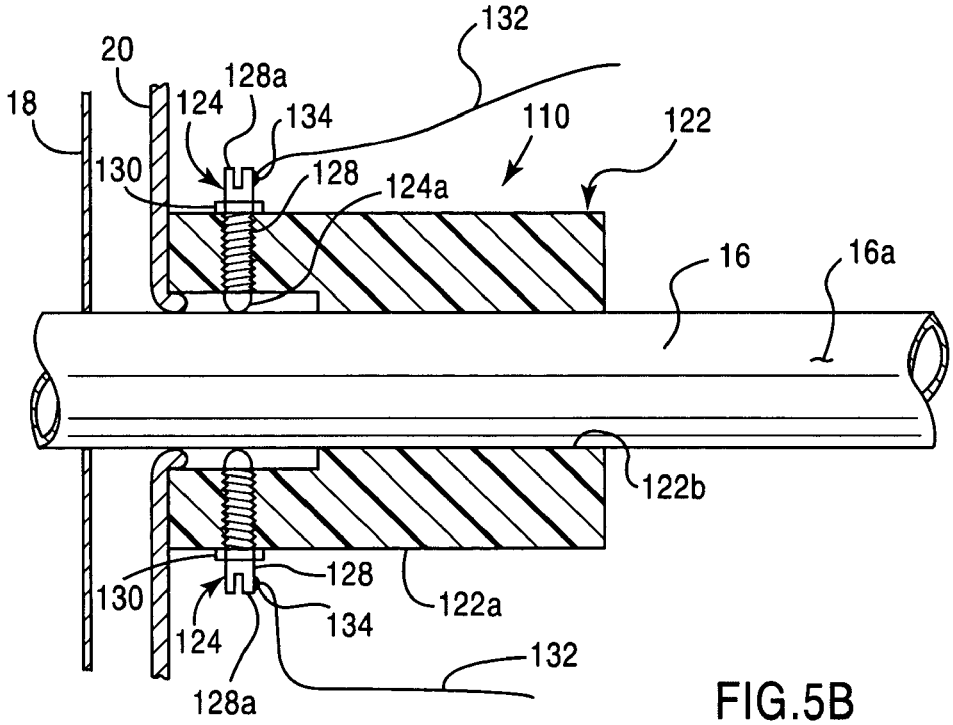
FIG. 5B is an enlarged cross-sectional view of the first exemplary embodiment of the dimension sensor of the present invention surrounding the tube in a desired expanded state and disposed against the tube sheet of the heat exchanger.

The dimension sensor 110 is used in conjunction with the heat exchanger tube 16 that has a tubular outer surface 16*a* and is fabricated from an electrically conductive material such as stainless steel. The dimension sensor 110 surrounds a portion of the heat exchanger tube 16 extending outwardly from the heat exchanger 8 adjacent the tube sheet 20 and shuts off the pumping device 114 of the tube expansion system 111 when the tubular outer surface 16*a* of the heat exchanger tube 16 expands from a pre-expanded state (FIGS. 5A and 6A) to a desired expanded state (FIGS. 5B and 6B)

As best shown in FIGS. 3-5B, the dimension sensor 110 includes a body member 122 and a plurality of detector elements 124. More specifically, the dimension sensor 110 includes a pair of detector elements 124. For the first exemplary embodiment of the dimension sensor 110, the body member 122 is fabricated from an electrically non-conductive material such as resin or plastic and the detector elements 124 are fabricated from an electrically conductive material such as metal. The body member 122 is cylindrically shaped and has a body member outer surface 122*a* and a body member inner surface 122*b*. The body member inner surface 122*b* defines an opening 126 in the body member 122 that is sized to receive the heat exchanger tube 16. Each detector element 124 is connected to the body member 122 and has a detector portion 124*a* extending into the opening 126. Respective ones of the detector portions 124*a* are disposed apart from one another and face opposite one another. More particularly, the respective ones of the detector portions 124*a* are disposed apart from one another at a distance X as shown in FIG. 5A representing the desired expanded state of the tubular outer surface 16*a* of the heat exchanger tube 16.

For the first exemplary embodiment of the dimension sensor 110, each detector portion 124*a* extends generally in a radially inwardly direction relative to the heat exchanger tube 16 received therein. A skilled artisan would appreciate that each detector portion 124*a* extends generally in the radially inwardly direction relative to the heat exchanger tube 16 because expansion of the heat exchanger tube 16 from a pre-expanded state to a desired expanded state results in a change of the radius of the heat exchanger tube 16.

Figure 3:
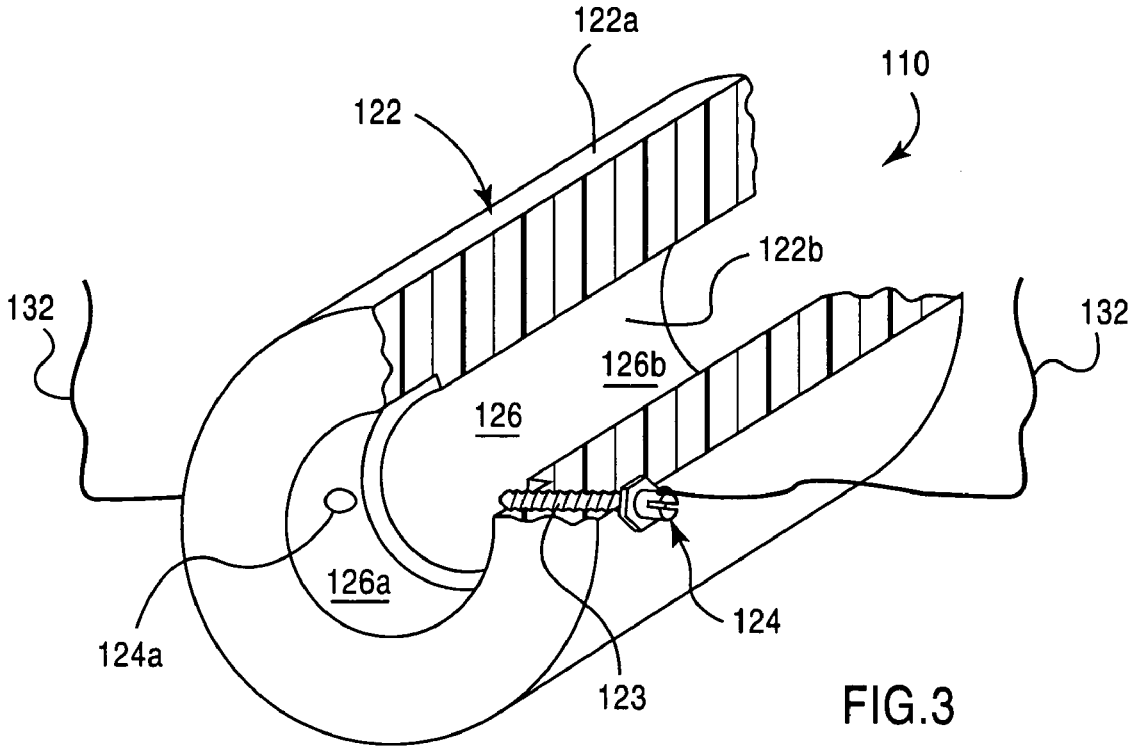
FIG. 3 is a perspective view partially broken away of a first exemplary embodiment of the dimension sensor of the present invention.
Figure 4:
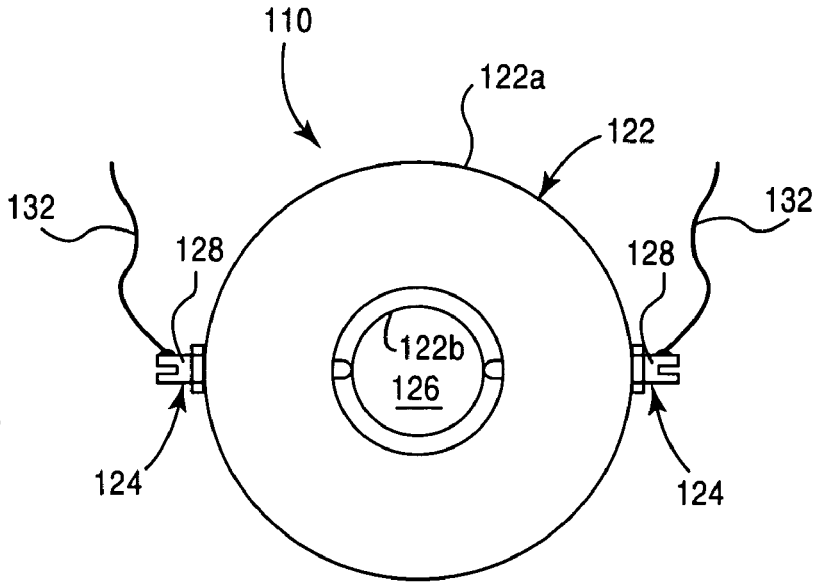
FIG. 4 is a side elevational view of the first exemplary embodiment of the dimension sensor of the present invention.

Although not by way of limitation, the opening 126 is cylindrically shaped. For the first exemplary embodiment of the dimension sensor 110, the opening 126 includes a first cylindrical opening portion 126*a* and second cylindrical opening portion 126*b* that are in communication with one another as best shown in FIGS. 3 and 5A. In FIG. 5A, the first cylindrical opening portion 126*a* has a first diameter Da and the second cylindrical opening portion 126*b* has a second diameter Db that is smaller than the first diameter Da. Further, respective ones of the detector portions 124*a* of the pair of detector elements 124 are disposed in the first cylindrical opening portion 124*a*.

For the first exemplary embodiment of the dimension sensor 110, the detector elements 124 includes a threaded screw shaft 128 fabricated from metal and threadably engaged with the body member 122 as best shown in FIGS. 5A and 5B. One of ordinary skill in the art would appreciate that the detector elements 124 are set screws. Each threaded screw shaft 128 has a slotted head 128*a*. Each detector portion 124*a* is operative to move towards and away from the heat exchanger tube 16 upon turning the threaded screw shaft 128, for example, by turning the slotted head 128*a* using a screwdriver. Also, each detector element 124 includes a nut 130 that is threadably engaged with the threaded screw shaft 128 and is disposed exteriorly of the body member 122. The nut 130 is operative to engage the body member outer surface 122*a* and to secure the threaded screw shaft to body member 122.

Additionally, a lead wire 132 is connected to each one the detector elements 124. The lead wires 132 can be secured to the detector elements 124 by any conventional manner. By way of example only, the lead wires 132 are connected to the detector elements 124 by weldments 134.

Figure 2:
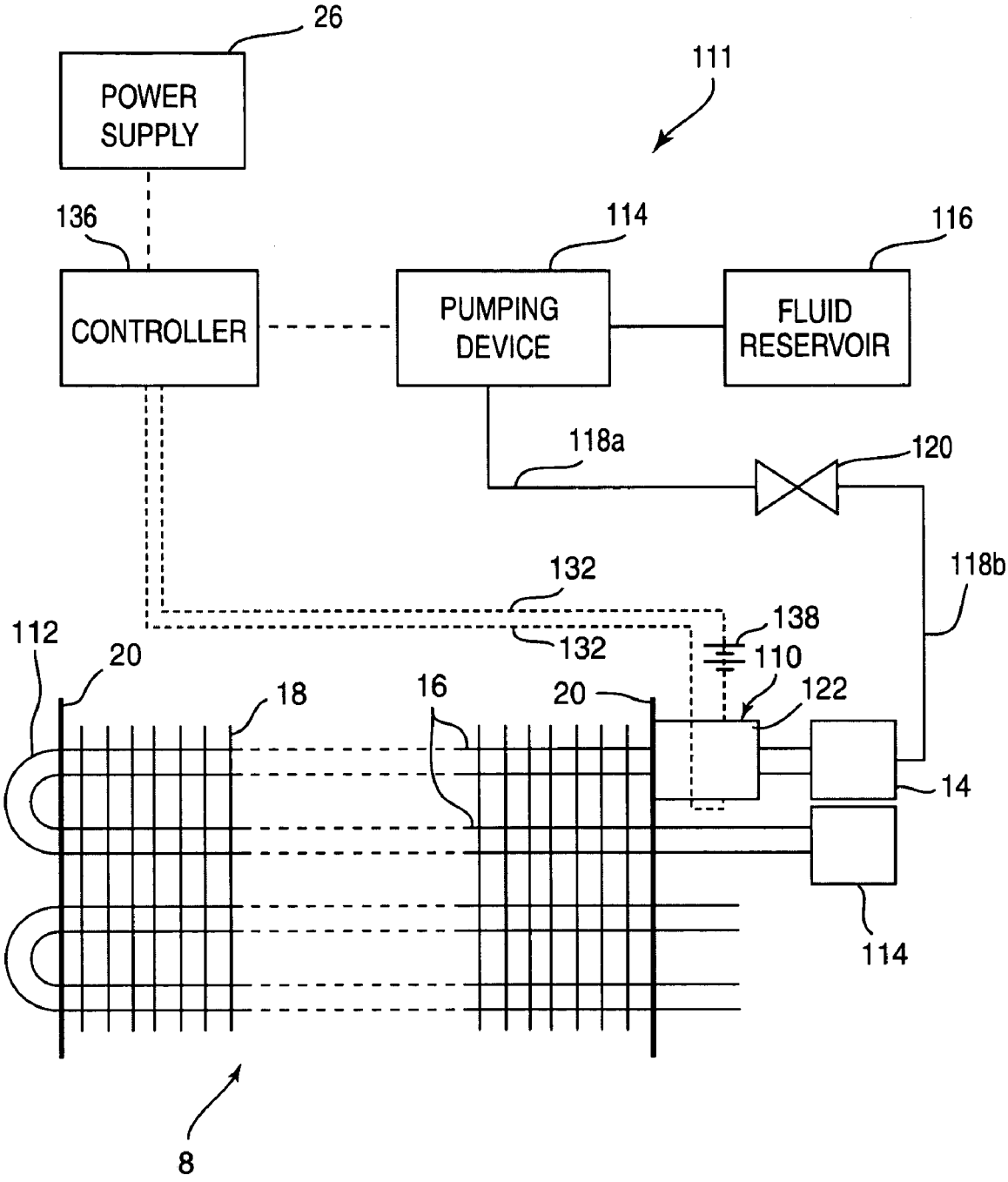
FIG. 2 is a diagrammatical view of a system and method for expanding heat exchanger tubes that employs a dimension sensor of the present invention.
Figure 6A:
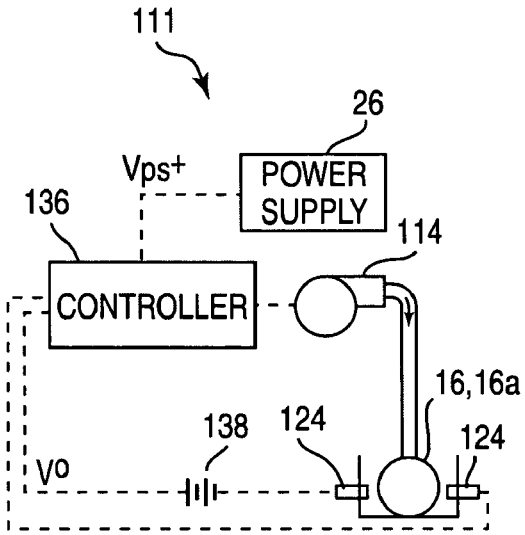
FIG. 6A is a diagrammatical view of an electrical circuit and partial hydraulic circuit with the dimension sensor of the first exemplary embodiment of the present invention in conjunction with the tube in the pre-expanded state and with a power supply supplying electric power to a pumping device.
Figure 6B:
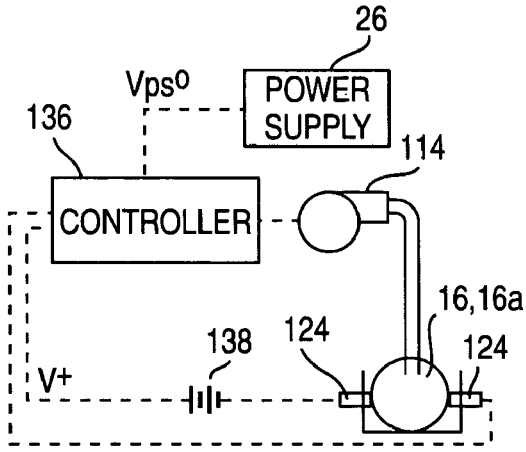
FIG. 6B is a diagrammatical view of an electrical circuit and partial hydraulic circuit with the dimension sensor of the first exemplary embodiment of the present invention in conjunction with the tube in the desired expanded state and with the power supply electrically disconnected from the pumping device.

As illustrated in FIGS. 2, 6A and 6B, the tube expansion system 111 includes a controller 136 and the power supply 26 in electrical communication with the pumping device 114 via wires represented by dashed lines. Also, the controller 136 is in electrical communication with the dimension sensor 110 via wires represented by dashed lines. Furthermore, an electrical source 138, such as a battery, is disposed in a manner to electrically connect the controller 136 with the dimension sensor 110. The dimension sensor 110 is disposed around a portion the heat exchanger tube 16 and is positioned facially against the tube sheet 20.

Since the pair of detector elements 124 and the heat exchanger tube 16 are fabricated from electrically-conductive materials, a person of ordinary skill in the art would appreciate that the pair of detector elements 124 and the heat exchanger tube 16 combine to form a first electrical circuit condition when the heat exchanger tube 16 is in the pre-expanded state (FIG. 6A) and form a second electrical circuit condition when the heat exchanger tube 16 is in the desired expanded state (FIG. 6B). Specifically, for the first exemplary embodiment of the dimension sensor 110, the first electrical circuit condition (FIG. 6A) is an opened electrical circuit condition having a zero voltage potential $V^0$ and the second electrical circuit condition (FIG. 6B) is a closed electrical circuit condition generating a positive voltage potential $V^+$. In the opened electrical circuit condition shown in FIG. 6A, the tubular outer surface 16*a* of the heat exchanger tube 16 fails to simultaneously contact the pair of detector elements 124, thereby allowing expansion of the tubular outer surface 16*a* when the pumping device 114 is activated to pump the fluid (illustrated as an arrow). For activating the pumping device 114, the power supply 26 provides a voltage potential $Vps^+$. In the closed electrical circuit condition (FIG. 6B), the tubular outer surface 16*a* of the heat exchanger tube 16 simultaneously contacts the pair of detector elements 124 thereby shutting off, i.e., deactivating, the pumping device 114 represented by a zero voltage potential $Vps^0$ and thereby terminating expansion of the tubular outer surface 16*a*.

Figure 7A:
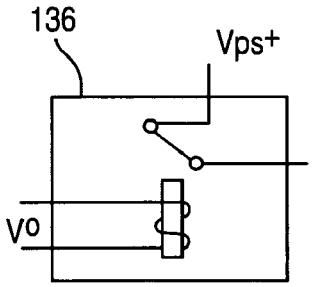
FIG. 7A is a diagrammatical view of a controller employing an exemplary relay circuit with the power supply supplying electric power to the pumping device as shown in FIG. 6A.
Figure 7B:
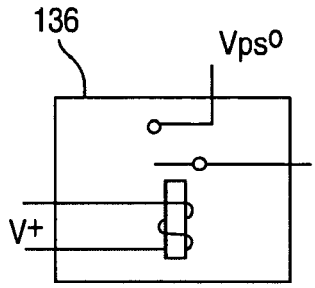
FIG. 7B is a diagrammatical view of the controller employing the exemplary relay circuit of FIG. 7A with the power supply electrically disconnected from the pumping device as shown in FIG. 6B.

By way of example only and not by way of limitation, for the first exemplary embodiment of the dimension sensor 110, the controller 136 can be a conventional relay device as diagrammatically shown in FIGS. 7A and 7B. A skilled artisan would appreciate that exemplary controller 136 of FIG. 7A relates to the opened electrical circuit condition in FIG. 6A and that the exemplary controller 136 of FIG. 7B relates to the closed electrical circuit condition to FIG. 6B.

Figure 8:
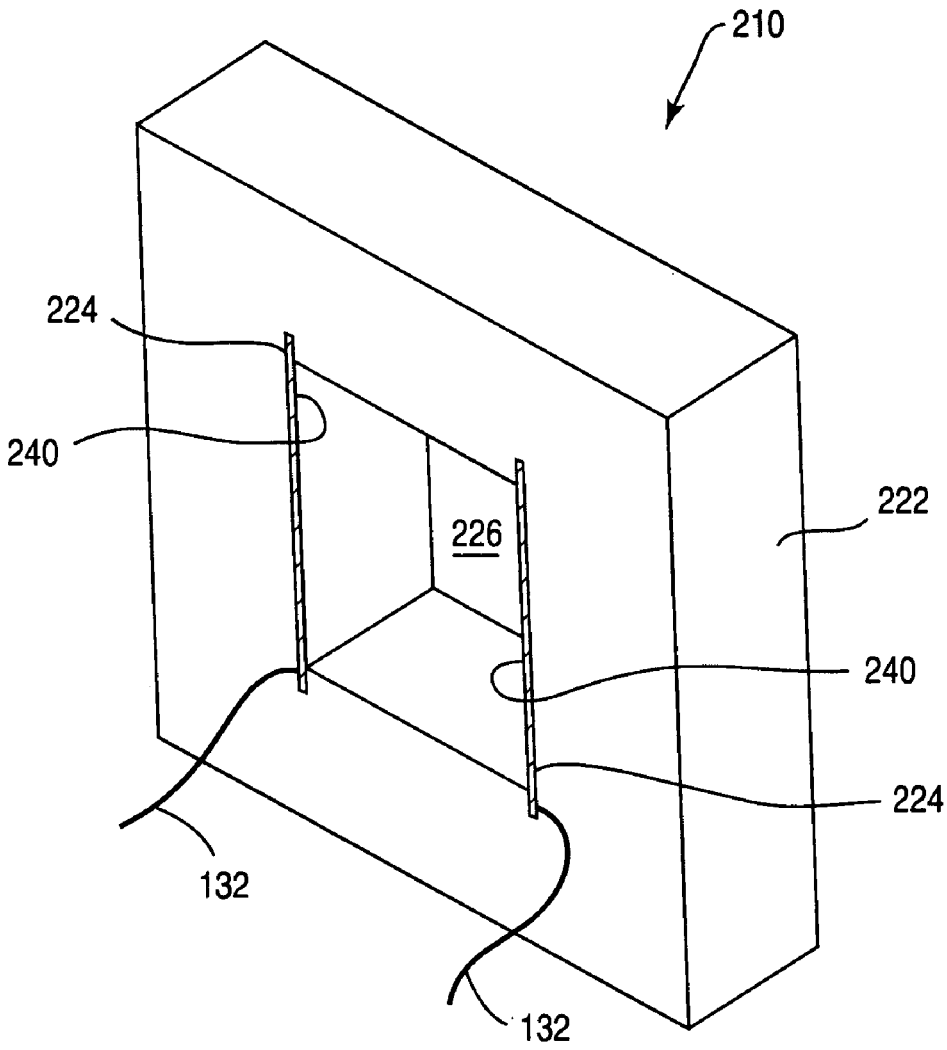
FIG. 8 is a perspective view a second exemplary embodiment of the dimension sensor of the present invention.

A second exemplary embodiment of a dimension sensor 210 as illustrated in FIG. 8 includes a body member 222 having a box-shaped configuration and a pair of detector elements 224 in a form of electrically conductive strips. A rectangular opening 226 extends through the body member 222. Respective ones of the detector elements 224 extend along opposing edges 240.

Figure 9A:
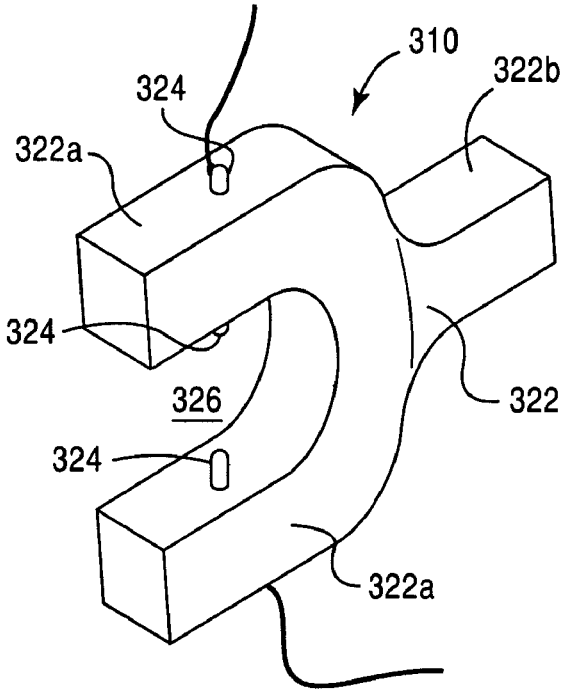
FIG. 9A is a perspective view of the dimension sensor of a third embodiment of the present invention in a form of a fork-shaped implement.
Figure 9B:
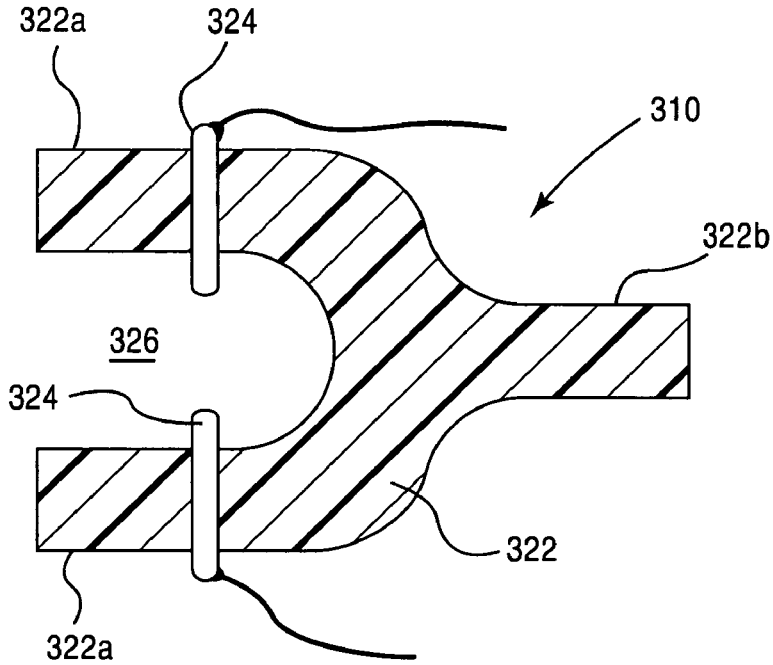
FIG. 9B is a cross-sectional view of the dimension sensor of the third embodiment of the present invention shown in FIG. 9A.

In FIGS. 9A and 9B, a third exemplary embodiment of a dimension sensor 310 includes a body member 322 configured in a shape of a fork and a pair of detector elements 324. The forked-shared body member 322 includes pair of prongs 322*a* that extend parallel to one another and are connected to a handle 322*b*. The body member 322 defines a U-shaped opening 326. Although not by way of limitation, the body member 322 is fabricated from an electrically non-conductive material such as plastic or resin and each one of the detector elements 324 is in a form of a pin. Each one of the detector elements 324 is fixedly connected to body member 322 such as by forcing fitting or injection molding. A respective one of the detector elements 324 extends through a respective one of the prongs 322*a* of the body member 322 and is fabricated from an electrically conductive material.

Figure 10:
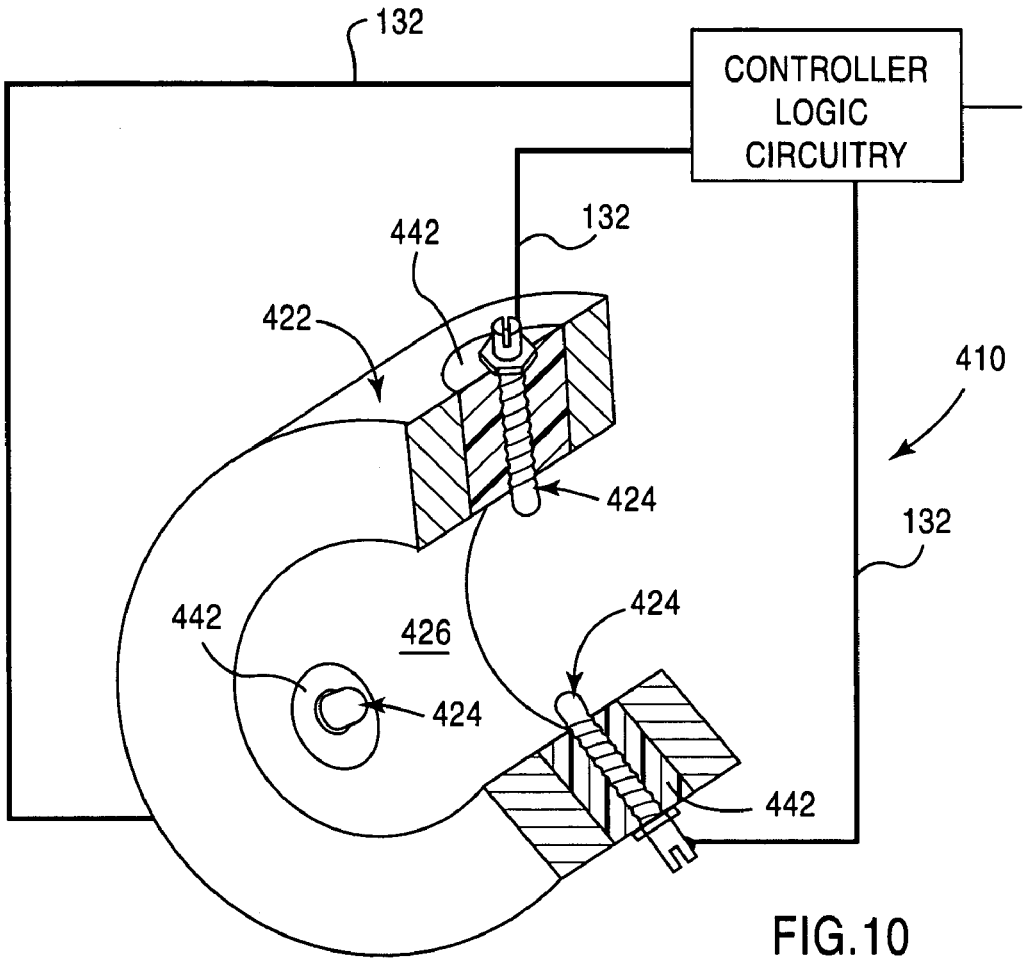
FIG. 10 is a perspective view partially broken away of a fourth exemplary embodiment of the dimension sensor of the present invention.
Figure 11:
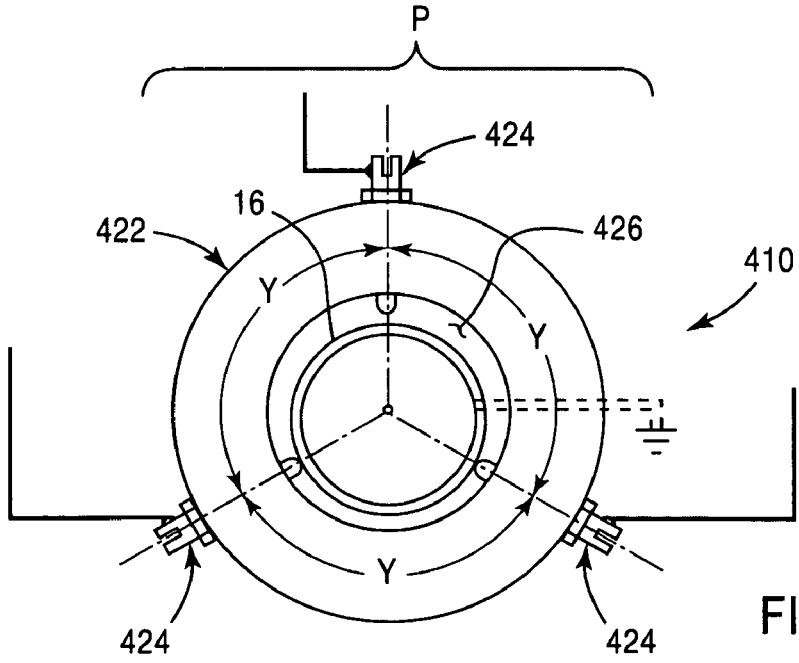
FIG. 11 is a side elevational view of the fourth exemplary embodiment of the dimension sensor of the present invention.

A fourth exemplary embodiment of a dimension sensor 410 as illustrated in FIGS. 10-13B. The dimension sensor 410 includes a cylindrically-shaped body member 422 and a plurality of detector elements 424. More specifically, the plurality of detector elements 444 includes three detector elements. The body member 422 defines a cylindrically-shaped opening 426 formed therethrough. Respective ones of the detector elements 424 are disposed equi-angularly apart from one another as viewed in cross-section about the opening 426 as represented by angle Y. Also, all three detector elements 424 are disposed in a common plane P as illustrated in FIG. 11.

As illustrated in FIG. 10, each one of the detector elements 424 are electrically connected to respective ones of lead wires 132. As a result of this electrical arrangement, the heat exchanger tube 16 shown in FIG. 11 is grounded. However, one of ordinary skill in the art would appreciate that the electrical arrangement can be made in any conventional manner without departing from the spirit and inventive concepts of the invention. By way of example only and not by way of limitation, one of the detector elements might be grounded in lieu of the heat exchanger tube while the remaining two detector elements are conductive.

The dimension sensor 410 includes a bushing 442 associated with each detector element 424. Each bushing 442 is connected to and extends into the body member 422. Each bushing is sized and adapted to be threadably engaged with the threaded screw shaft 128. Each bushing is fabricated from an electrically non-conductive material such as resin, plastic or rubber. As a result, the body member 442 can be fabricated from an electrically conductive material such as metal.

Figure 12A:
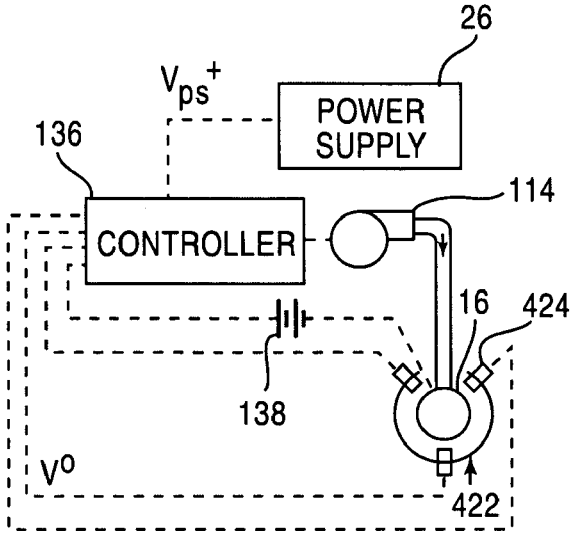
FIG. 12A is a diagrammatical view of an electrical circuit and partial hydraulic circuit with the dimension sensor of the fourth exemplary embodiment of the present invention in conjunction with the tube in the pre-expanded state and with a power supply supplying electric power to the pumping device.
Figure 12B:
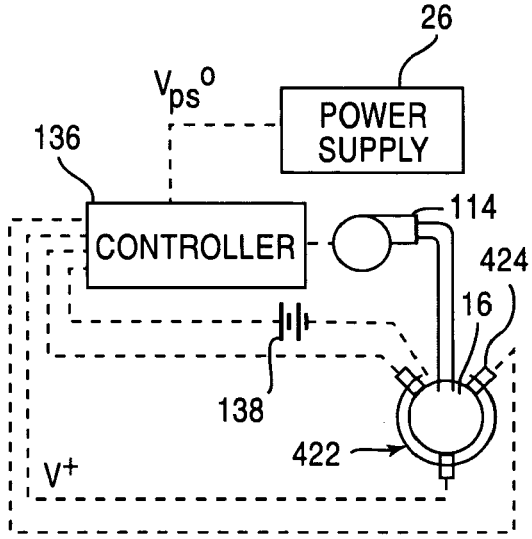
FIG. 12B is a diagrammatical view of an electrical circuit and partial hydraulic circuit with the dimension sensor of the fourth exemplary embodiment of the present invention in conjunction with the tube in the desired expanded state and with the power supply electrically disconnected to the pumping device.
Figure 13A:
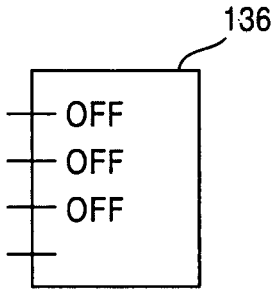
FIG. 13A is a diagrammatical view of the controller employing an exemplary logic circuit with the power supply supplying electric power to the pumping device as shown in FIG. 12A.
Figure 13B:
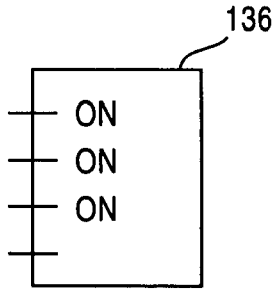
FIG. 13B is a diagrammatical view of the controller employing the exemplary logic circuit of FIG. 13A with the power supply electrically disconnected to the pumping device as shown in FIG. 12B.
Figure 14:
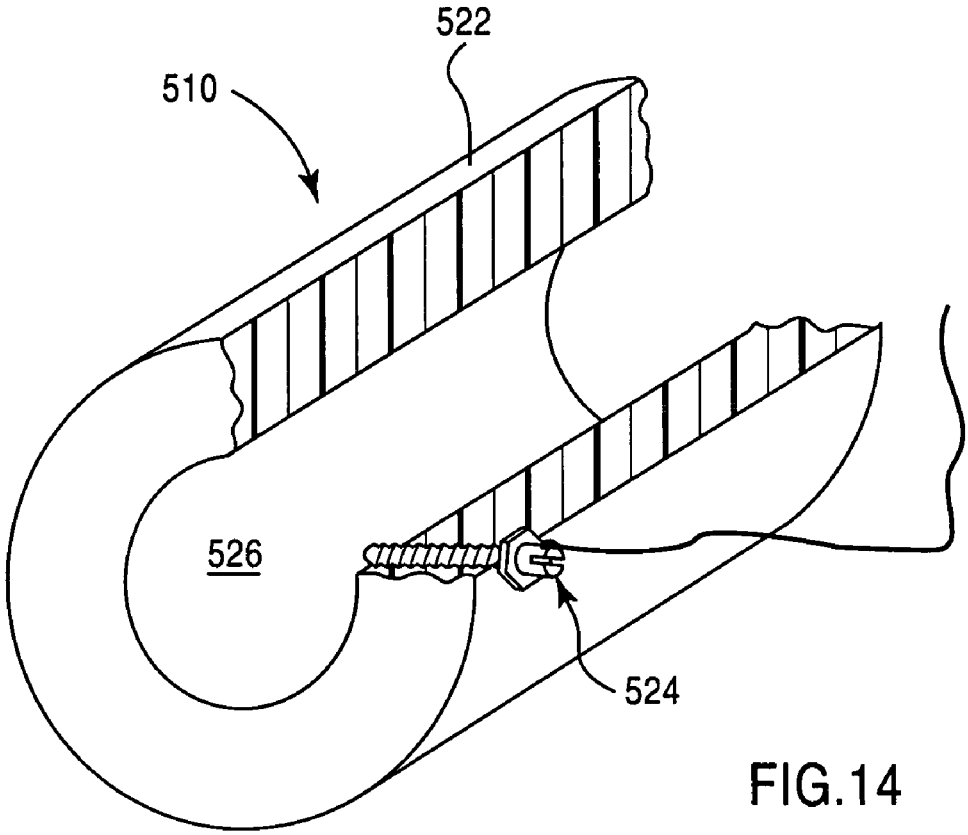
FIG. 14 is a perspective view partially broken away of a fifth exemplary embodiment of the dimension sensor of the present invention.
Figure 15:
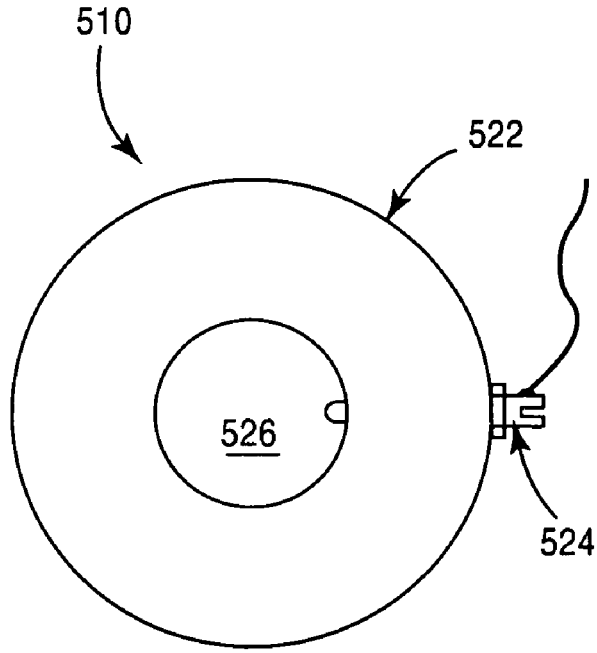
FIG. 15 is a side elevational view of the fifth exemplary embodiment of the dimension sensor of the present invention.

In FIG. 12A, the heat exchanger tube 16 in its pre-expanded state fails to contact all three of the detector elements 424 simultaneously and, therefore, the opened electrical circuit condition exists thereby allowing expansion of the tubular outer surface since the pump device 114 is activated by the power supply 26. In FIG. 12B, the heat exchanger tube 16 in its desired expanded state simultaneously contacts all three detector elements 424 thereby creating the closed electrical circuit condition thus shutting off the pumping device 114 and terminating expansion of the tubular outer surface of the heat exchanger tube. Although not by way of limitation, the controller 136 is in a form of a logic circuit. The logic circuit represented in diagrammatical form in FIG. 13A indicates three OFF conditions because none of the three detector elements 424 are in contact with the tubular outer surface of the heat exchanger tube. The logic circuit represented in diagrammatical form in FIG. 13B indicates three ON conditions because all of the three detector elements 424 are in contact with the tubular outer surface of the heat exchanger tube. A skilled artisan would appreciate that the logic circuit in FIG. 13A corresponds to the controller 136 in FIG. 12A and the logic circuit in FIG. 13B corresponds to the controller 136 in FIG. 12B.

Figure 16A:
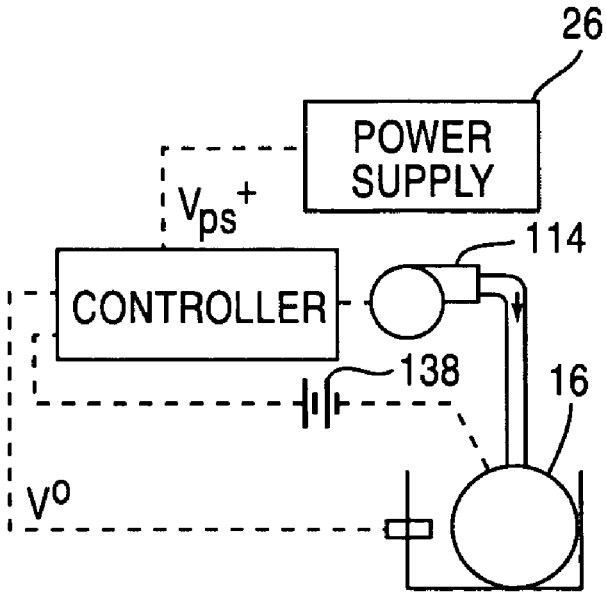
FIG. 16A is a diagrammatical view of an electrical circuit and partial hydraulic circuit with the dimension sensor of the fifth exemplary embodiment of the present invention in FIGS. 14 and 15 as a single detector element in conjunction with the tube in the pre-expanded state and with a power supply supplying electric power to the pumping device.
Figure 16B:
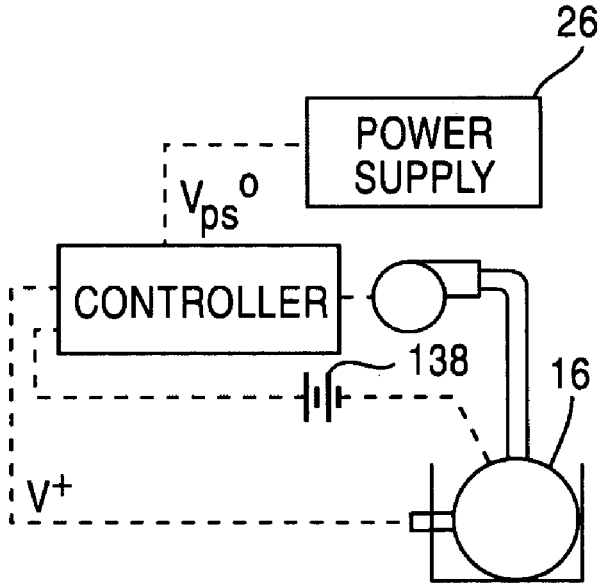
FIG. 16B is a diagrammatical view of an electrical circuit and partial hydraulic circuit with the dimension sensor of the fifth exemplary embodiment of the present invention in FIGS. 14 and 15 as a single detector element in conjunction with the tube in the desired expanded state and with the power supply electrically disconnected from the pumping device.

A fifth exemplary embodiment of a dimension sensor 510 illustrated in FIGS. 14-16B includes a body member 522 and only one detector element 524. The body member 522 is cylindrically shaped and includes a cylindrically shaped opening 526. As shown in FIG. 16A, the heat exchanger tube being fabricated from an electrically conductive material is electrically connected with the electrical source 138. The heat exchanger tube 16 in its pre-expanded state fails to contact the detector element 524 and, therefore, the opened electrical circuit condition exists thereby allowing expansion of the tubular outer surface since the pumping device 114 is activated by the power supply 26. In FIG. 16B, the heat exchanger tube 16 in its desired expanded state contacts the detector element 524 thereby creating the closed electrical circuit condition thus shutting off the pumping device 114 and terminating expansion of the tubular outer surface of the heat exchanger tube.

Figure 17A:
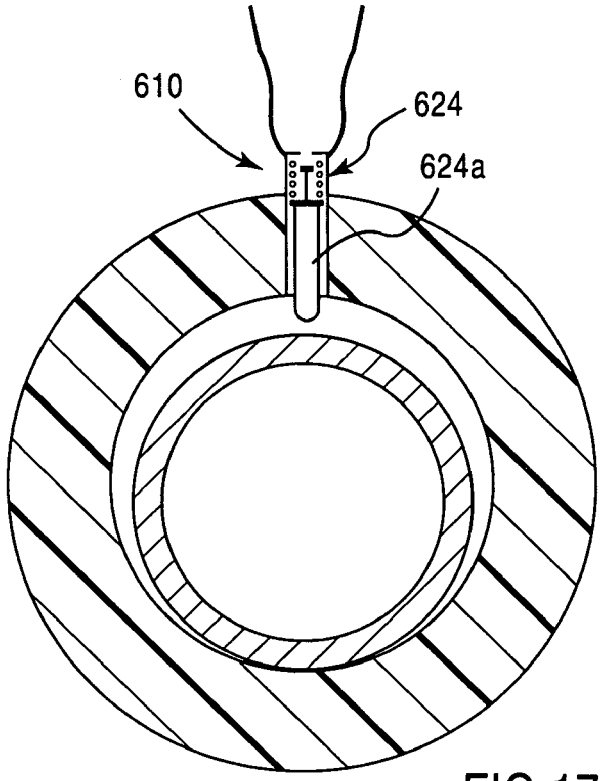
FIG. 17A is a side elevational view partially in cross-section illustrating a sixth exemplary embodiment of the dimensional sensor of the present invention incorporating a switch.
Figure 17B:
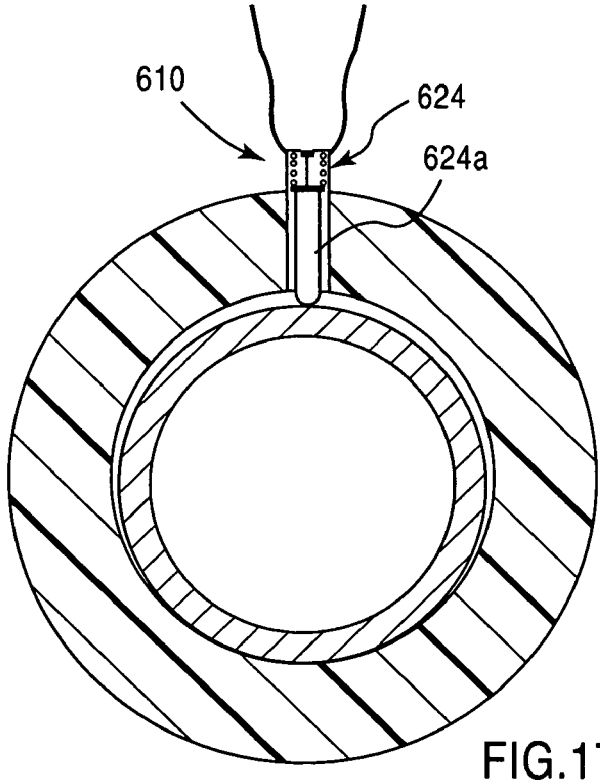
FIG. 17B is a side elevational view partially in cross-section illustrating the sixth exemplary embodiment of the dimensional sensor of the present invention incorporating the switch shown in a closed circuit state while the tube is in the desired expanded state.

A sixth embodiment of a dimension sensor 610 is illustrated in FIGS. 17A and 17B. A difference between the fifth exemplary embodiment of the dimension sensor 510 and the sixth exemplary embodiment 610 is that the only one detector element is a switch 624. In FIG. 17A, the switch 624 is in the opened electrical circuit condition thereby allowing expansion of the tubular outer surface since the pump device is activated by the power supply. In FIG. 17B, the switch 624 is in the closed electrical circuit condition thus shutting off the pumping device 114 and terminating expansion of the tubular outer surface of the heat exchanger tube.

One of ordinary skill in the art would appreciate that for the sixth embodiment of the dimension sensor 610 as the heat exchanger tube is expanding, the expanding tube simultaneously contacts and displaces a detector portion 624*a* of the switch 624 so that the switch 624 can move from the opened electrical circuit condition to the closed electrical circuit condition. Also, while the tube is expanding, the expanding tube simultaneously contacts and displaces the detector portion 624*a* of the switch 624. In contrast to the first through the fifth embodiments of the dimension sensor discussed above, in the pre-expanded state and while the tube is expanding, the detector element or detector elements and the heat exchanger tube are disposed apart from one another and, in the desired expanded state, the detector element or detector elements and the tube contact one another in order to deactive, i.e. shut off, the pumping device. In short, there is no movement of the detector element or detector elements with regard to the first through the fifth exemplary embodiments of the dimension sensor.

In summary, the dimension sensor of the present invention is used in conjunction with a tube and includes a body member and at least one detector element. The body member has an outer surface and an inner surface defining an opening sized to receive the tube. The at least one detector element is connected to the body member and has a detector portion extending into the opening generally in a radially inwardly direction relative to the tube received therein. The dimension sensor has an opened electrical circuit condition when the detector portion and the tube are disposed apart from one another and has a closed electrical circuit condition when the tube and the detector portion contact each other. Alternatively, the dimension sensor has an opened electrical circuit condition when the detector portion and the tube are disposed apart from one another and has a closed electrical circuit condition when the tube displaces the detector portion of the detector element a sufficient distance. A skilled artisan would appreciate that the sufficient distance is an amount of displacement required for the detector portion 624*a* to move radially outwardly in order to produce a closed electrical circuit condition as typically occurs with any conventional damper-type switch.

Figure 18A:
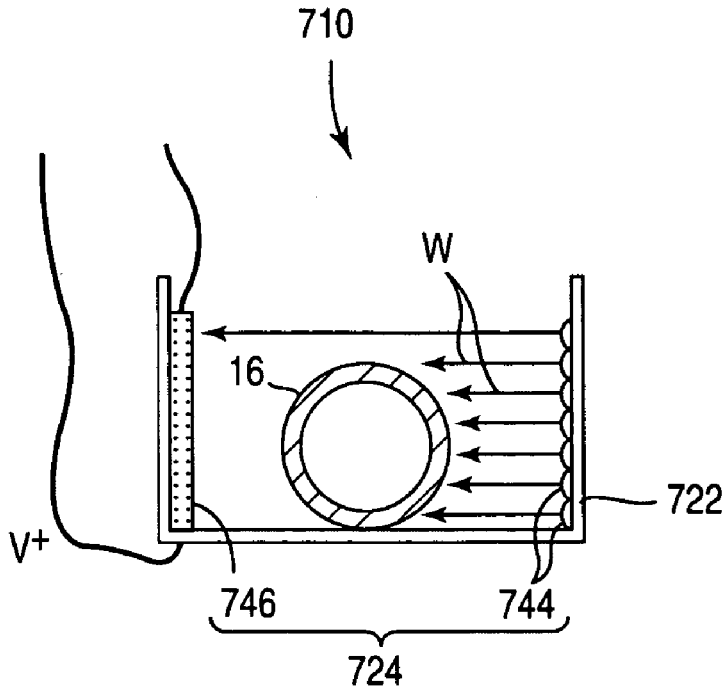
FIG. 18A is a side elevational view of the dimension sensor of a seventh exemplary embodiment of the present invention as a laser light and CMOS panel assembly with laser light impinging partially upon the CMOS panel to generate a voltage with the tube in the pre-expanded state.
Figure 18B:
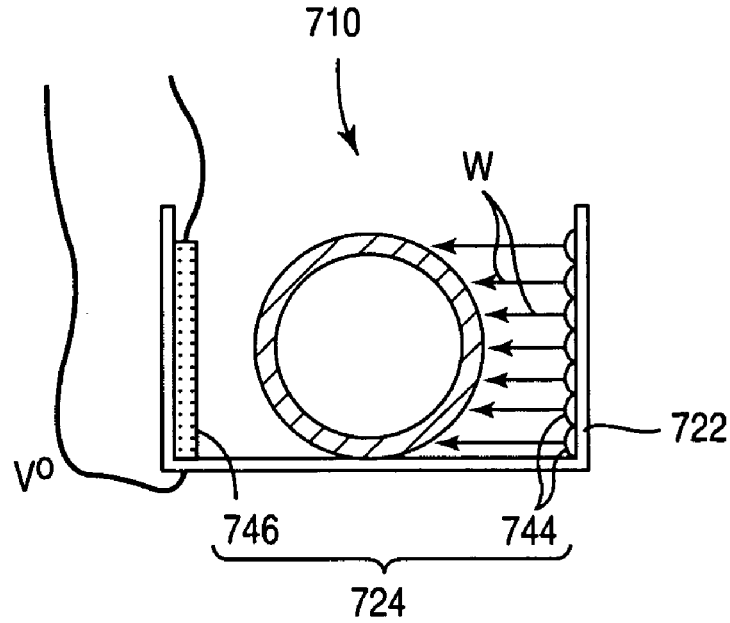
FIG. 18B is a side elevational view of the dimension sensor of the seventh exemplary embodiment of the present invention as a laser light and CMOS panel assembly with laser light being blocked from impinging upon the CMOS panel by the tube in the desired expanded state.

A seventh exemplary embodiment of a dimension sensor 710 illustrated in FIGS. 18A and 18B includes a body member 722 in a form of U-shaped channel member and a detector element 724 in a form of a laser light detector assembly. The laser light detector assembly acting as a switch includes a plurality of laser light elements 744 and a CMOS panel 746. The heat exchanger tube 16 is disposed in the body member 722 and between the laser light elements 744 and the CMOS panel 746. As shown in FIG. 18A, when the heat exchanger tube 16 is in the pre-expanded state, some of the laser light beams illustrated as arrows W impinge upon the CMOS panel creating a voltage $V^+$. As shown in FIG. 18B, when the heat exchanger tube 16 has been expanded to the desired expanded state, none of the laser beams W impinge upon the CMOS panel and thus no voltage is created as represented by $V^0$ . In view of this seventh exemplary embodiment of the dimension sensor 710, a skilled artisan would appreciate that the voltage $V^+$ can be use with the controller 136 when the pumping device is activate to expand the tubular outer surface of the heat exchanger tube and that no voltage $V^0$ might be used to stop expansion of the heat exchanger tube when it expands to the desired expanded state.¶

In summary, the detector element and the tube form a first electrical circuit condition when the tube is in the pre-expanded state and form a second electrical circuit condition when the tube is in the desired expanded state. If the first electrical circuit condition is an opened electrical circuit condition, then the second electrical circuit condition is a closed electrical circuit condition. If the first electrical circuit condition is the closed electrical circuit condition, then the second electrical circuit condition is the opened electrical circuit condition.

An eighth embodiment of the present invention is method for stopping expansion of the tube expanding from a pre-expanded state to a desired expanded state. The tube is expanded from the pre-expanded state to the desired expanded state by a fluid pressurized by a pumping device. One step of the method includes actuating the pumping device to pressurize the fluid by an amount sufficient to cause the tube to expand from the pre-expanded state to the desired expanded state. Another step is providing a detector element operative in conjunction with the tube only in the desired expanded state such that when the tube expands to the desired expanded state, the pumping device deactivates thereby stopping expansion of the tube at the desired expanded state.

The present invention, may, however, be embodied in various different forms and should not be construed as limited to the exemplary embodiments set forth herein. Rather, these exemplary embodiments are provided so that this disclosure will be thorough and complete and will fully convey the scope of the present invention to those skilled in the art. For example, other conventional switches such as proximity switches might be used that are capable of performing the functions herein described. Also, the pumping device can be a hydraulic pump for pumping incompressible fluid such as water or a compressor for compressing compressible fluid such as air. Furthermore, one of ordinary skill in the art would appreciate that the drawing figures are exaggerated to illustrate the inventive concepts. Specifically, the relative sizes of the heat exchanger tubing in the pre-expanded state and in the desired expanded state are exaggerated for the purposes of easily conveying to the reader the concepts of the invention. Furthermore, the present invention could be used for expanding other types of tubes other than heat exchanger tubes regardless if such tubes are fabricated from electrically conductive or electrically non-conductive material. However, a skilled artisan would appreciate that every embodiment of the invention might not apply to every type of tube. Also, the arrangement of the electrical circuitry and components can be made in any conventional manner without departing from the spirit and scope of the invention.

What is claimed is:

1. A dimension sensor adapted for use in conjunction with a tube, comprising:

a body member having an outer surface and an inner surface defining an opening sized to receive the tube, the outer surface disposed apart from the inner surface to define a body member thickness therebetween; and at least one elongated detector element connected to the body member and having a first end portion, a detector portion and an intermediate portion disposed between the first portion and the detector portion, the first end portion projecting away from the outer surface, the intermediate portion being enveloped by the body member thickness of the body member and the detector portion extending into the opening from the inner surface and, when the tube is received in the opening, the detector portion is initially disposed apart from the tube.

2. A dimension sensor according to claim 1, wherein the dimension sensor has an opened electrical circuit condition when the detector portion and the tube are disposed apart from one another and has a closed electrical circuit condition when the tube and the detector portion contact each other.

3. A dimension sensor according to claim 1, wherein the dimension sensor has an opened electrical circuit condition when the detector portion and the tube are disposed apart from one another and has a closed electrical circuit condition when the tube displaces the detector portion a sufficient distance.

4. A dimension sensor according to claim 3, wherein the at least one detector element is one of a switch and a laser light and CMOS panel assembly.

5. A dimension sensor according to claim 1, wherein the at least one detector element includes a threaded screw shaft fabricated from metal.

6. A dimension sensor according to claim 5, wherein the body member is fabricated from an electrically non-conductive material and the threaded screw shaft is threadably engaged with the body member.

7. A dimension sensor according to claim 6, wherein the detector portion is operative to move towards and away from the tube upon turning the threaded screw shaft.

8. A dimension sensor according to claim 6, wherein the detector portion extends generally in a radially inwardly direction relative to the tube received therein.

9. A dimension sensor adapted for use in conjunction with a tube, comprising:

a body member having an outer surface and an inner surface defining an opening sized to receive the tube; and at least one detector element connected to the body member and having a detector portion extending into the opening and, when the tube is received in the opening, the detector portion is initially disposed apart from the tube, wherein the at least one detector element includes a threaded screw shaft fabricated from metal, wherein the body member is fabricated from an electrically non-conductive material and the threaded screw shaft is threadably engaged with the body member, and wherein the at least one detector element includes a nut threadably engaged with the threaded screw shaft and disposed exteriorly of the body member, the nut operative to engage the body member outer surface and to secure the threaded screw shaft to body member.

10. A dimension sensor adapted for use in conjunction with a tube, comprising:

a body member having an outer surface and an inner surface defining an opening sized to receive the tube;

at least one detector element connected to the body member and having a detector portion extending into the opening and, when the tube is received in the opening, the detector portion is initially disposed apart from the tube; and at least one bushing connected to and extending into the body member, the at least one bushing sized and adapted to be threadably engaged with the threaded screw shaft and wherein the body member is fabricated from an electrically conductive material and the at least one bushing is fabricated from an electrically non-conductive material, wherein the at least one detector element includes a threaded screw shaft fabricated from metal.

* * * * *